US005192941A

United States Patent [19]

Fishovitz et al.

[11] Patent Number: 5,192,941

[45] Date of Patent: Mar. 9, 1993

[54] OVERCURRENT TRIP SWITCH

[75] Inventors: Anthony J. Fishovitz, New Sewickley Twp., Beaver Cty.; Allan V. Heberling, Daugherty Twp., Beaver Cty.; Thomas K. Fogle, Shaler; Michael W. Chlystek, McMurray, all of Pa.

[73] Assignee: Westinghouse Electric Corp., Pittsburgh, Pa.

[21] Appl. No.: 706,922

[22] Filed: May 29, 1991

[51] Int. Cl.[5] ..... G08B 21/00

[52] U.S. Cl. ..... 340/638; 335/17; 340/635

[58] Field of Search ..... 340/635, 638, 639; 335/17; 200/400; 324/424

[56] References Cited

U.S. PATENT DOCUMENTS 4,301,433 11/1981 Castonguay et al. ..... 335/17 X
4,408,174 10/1983 Seymour et al. ..... 335/20
4,939,490 7/1990 Bernier et al. ..... 335/17

*Primary Examiner*—Jin F. Ng
*Assistant Examiner*—Jeffery A. Hofsass
*Attorney, Agent, or Firm*—M. J. Moran

[57] ABSTRACT

An alarm assembly for use with a circuit breaker is provided. The assembly is used with the flux shunt trip device of the circuit breaker. The flux shunt trip device has a plunger which moves from a retracted position to an extended position to interrupt current through the circuit breaker upon a predetermined condition. The assembly includes an actuating member mounted in engageable relationship with the plunger so that when the plunger moves to its extended position, the actuating member moves to an actuated position. In the actuated position, the actuating member contacts a switch mechanism to actuate a switch which may be connected to an alarm or light indicator to identify that the circuit breaker has tripped. The actuating member remains in its actuated position until it is manually reset. A mechanism is provided for reset of the device.

8 Claims, 4 Drawing Sheets

OVERCURRENT TRIP SWITCH

BACKGROUND OF THE INVENTION

1. Field of the Invention

This invention relates to an overcurrent trip switch operable with a flux shunt trip device in a circuit breaker. More particularly, during a trip event the switch is actuated by an actuating member which interacts with the flux shunt trip device.

2. Background Information and Description of the Prior Art

Circuit breakers provide protection against various faults in an electrical power system such as overcurrent, ground faults and short circuits. It is desirable to provide an alarm assembly in a circuit breaker to generate an audible or a visual signal that the circuit breaker has tripped. This will allow an operator to receive an immediate indication that the system should be inspected and the cause of the trip investigated.

It has been known to provide alarm assemblies on certain circuit breakers in order to give either audible or visual indications that the circuit breaker has tripped. Typically, these alarms have been electronically controlled. More particularly, switches are activated by an associated power relay module which is purely electronic. The trip unit will send a signal to the power relay module which will set switches which may control an audible alarm or a light indicator. As mentioned above, this indicates to an operator that the circuit breaker has tripped.

The difficulty with such electronic devices is that they require control power. If power is lost in the system, the switches will not be activated under appropriate circumstances. Thus, there remains a need for a mechanically activated switching device which will operate without the need for separate control power. Some mechanically activated switches have been known to be provided on some circuit breakers, however, it has not heretofore been known to provide such a device which is operable in response to a flux shunt trip mechanism.

Some circuit breakers include a flux shunt trip mechanism. The flux shunt trip mechanism incorporates a permanent magnet. The device has a spring-loaded plunger which when released to an extended position causes the circuit breaker to trip. Under normal operating conditions, the plunger is maintained in a retracted position by the magnetic force of the permanent magnet. A trip coil is placed adjacent to the plunger. When the trip coil is energized upon a predetermined trip condition being reached, a magnetic flux is thereby generated. This magnetic flux opposes the magnetic flux of the permanent magnet. The opposing flux counterbalances the magnetic flux of the permanent magnet, and the spring force on the plunger then causes the plunger to move to its trip position.

There remains a further need for a mechanical device which can only be reset manually after it has been actuated by a trip event in the circuit breaker. There remains yet a further need for a mechanical device which interacts with the flux shunt trip mechanism of a circuit breaker.

SUMMARY OF THE INVENTION

These and other needs are satisfied by the device of the present invention which comprises a switching device for use with the flux shunt trip mechanism in a circuit breaker. The device is an alarm assembly which interacts with the plunger of the flux shunt trip device. More specifically, the flux shunt trip device of the circuit breaker has a plunger which is movable between an extended position and a retracted position. As mentioned above, a trip coil is energized upon a predetermined trip condition. When the trip coil is energized, it generates a flux which opposes the flux of a permanent magnet also contained within the flux shunt trip device. The flux of the permanent magnet normally retains the plunger in its retracted position. However, when that flux is opposed by the flux of the energized coil, the spring-loaded plunger is forced into its extended position. In this position the plunger activates a trip mechanism which interrupts current through the circuit breaker. The present invention provides an actuating member which is preferably a preformed lever arm member having a pair of extension legs which partially surround the plunger of the flux shunt trip device. The plunger has an annular shoulder of greater diameter than the body portion of the plunger. This annular shoulder interacts with the extension legs on the actuating member. When the plunger moves to its extended position its annular shoulder engages the extension member on the actuating member causing the actuating member to move to its actuated position.

A conventional switch is mounted with respect to the actuating member so that when the actuating lever moves to its actuated position the switch is activated. It is desirable that the lever be maintained in the actuated position until it is manually reset to its initial position by an operator. Thus, the lever is constructed so that it will remain in the actuated position even though the plunger returns to its initial retracted position. One preferred embodiment includes placing a detent in the bracket upon which the lever is mounted. On the lever and extending towards the detent is a protruding extension portion which when the actuating member rotates to its actuated position falls into the detent and maintains the lever in that position until it is manually removed from that position.

In order to reset the circuit breaker, a plate is provided in conjunction with a push button located on the outside panel of the circuit breaker. The plate is mounted so that it will move towards the actuating member when the push button is pressed. A protrusion is located on the actuating member which is engaged by the plate to force the actuating member to return to its initial position. In the initial position the lever will be ready to be engaged by the plunger on the next trip event.

If desired, a spring means can be provided to bias the actuating member into its initial position.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

Figure 1:
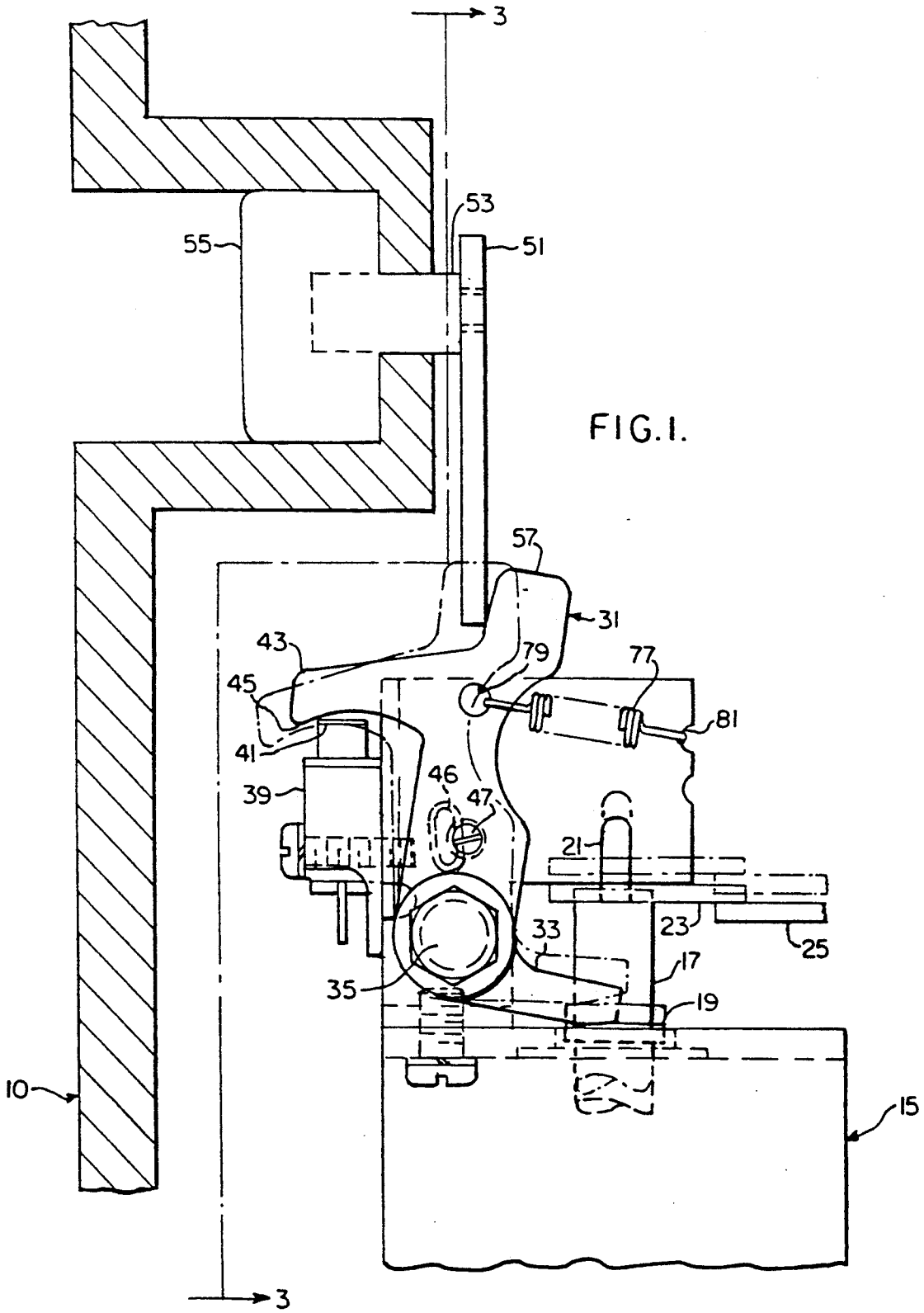
FIG. 1 is a schematic fragmentary vertical view through a circuit breaker incorporating an alarm assembly in accordance with the present invention.

Referring to FIG. 1, a portion of a circuit breaker with a flux shunt trip mechanism is shown. The molded housing 10 of the circuit breaker encases the internal components. The circuit breaker has flux shunt trip device 15 having plunger 17 associated therewith. Plunger 17 has annular rim 19 which is of a greater diameter than body portion 17. The plunger 17 will move upwardly to an extended position when flux shunt trip device 15 is energized in response to a trip condition in the manner described in detail hereinbefore. Plunger 17 has protruberance 21 which engages lever 23 when flux shunt trip device 15 is energized and plunger 17 moves to its extended position. When lever 23 is moved by plunger 17, this provides for release of toggle lever 25 and ultimate interruption of the circuit breaker through an associated trip mechanism. The associated trip mechanism is described in further detail in commonly owned U.S. Pat. No. 4,166,205 which is incorporated herein by reference.

In accordance with the present invention, actuating member 31 is mounted within the circuit breaker such that it will interact with plunger 17. Actuating member 31 is mounted upon an L-shaped bracket (FIG. 2) composed of bracket portions 37 and 38. Actuating member 31 is mounted to bracket portion 37 which faces plunger 17. Member 31 is an elongated body having a tubular member 36 extending laterally out from the elongated body of member 31. Member 31 is mounted through tubular member 36 on pin 35 which passes through bracket portion 37 and is secured in a suitable manner such as by a nut 40, shown in FIG. 3, which is fastened to the end of pin 35 on the opposite side of bracket portion 37.

Figure 2:
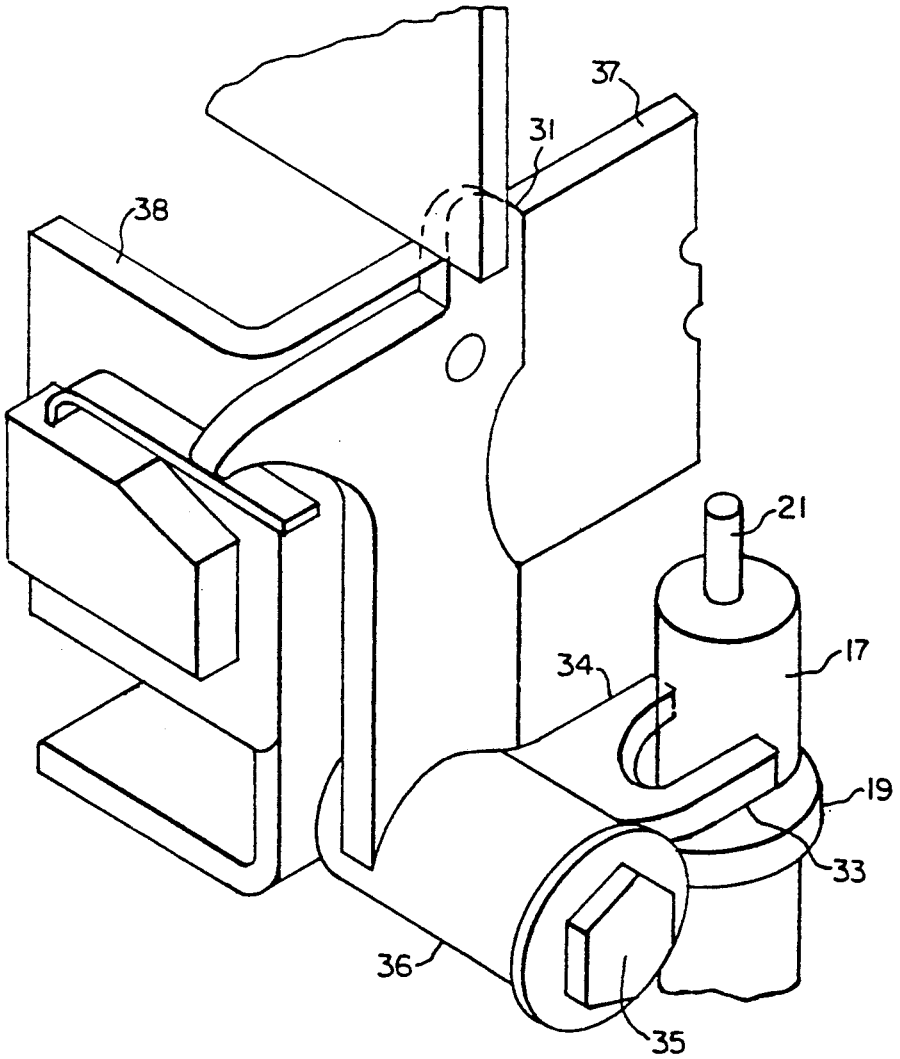
FIG. 2 is an isometric illustration of the actuating member and plunger which form a part of the alarm assembly shown in FIG. 1.

Actuating member 31 has extension legs 33 and 34 extending from tubular member 36 as shown in FIG. 2. The extension legs 33 and 34 protrude on either side of plunger 17. Extension legs 33 and 34 abut annular shoulder 19 of plunger 17 as shown in FIG. 2. When plunger 17 moves to its extended position in response to a trip event, annular shoulder 19 lifts the legs 33 and 34 upward. This causes actuating member 31 to rotate about pin 35 upon which it is mounted. Actuating member 31 rotates counterclockwise as shown in phantom in FIG. 1 when legs 33 and 34 are lifted by annular shoulder 19.

Figure 3:
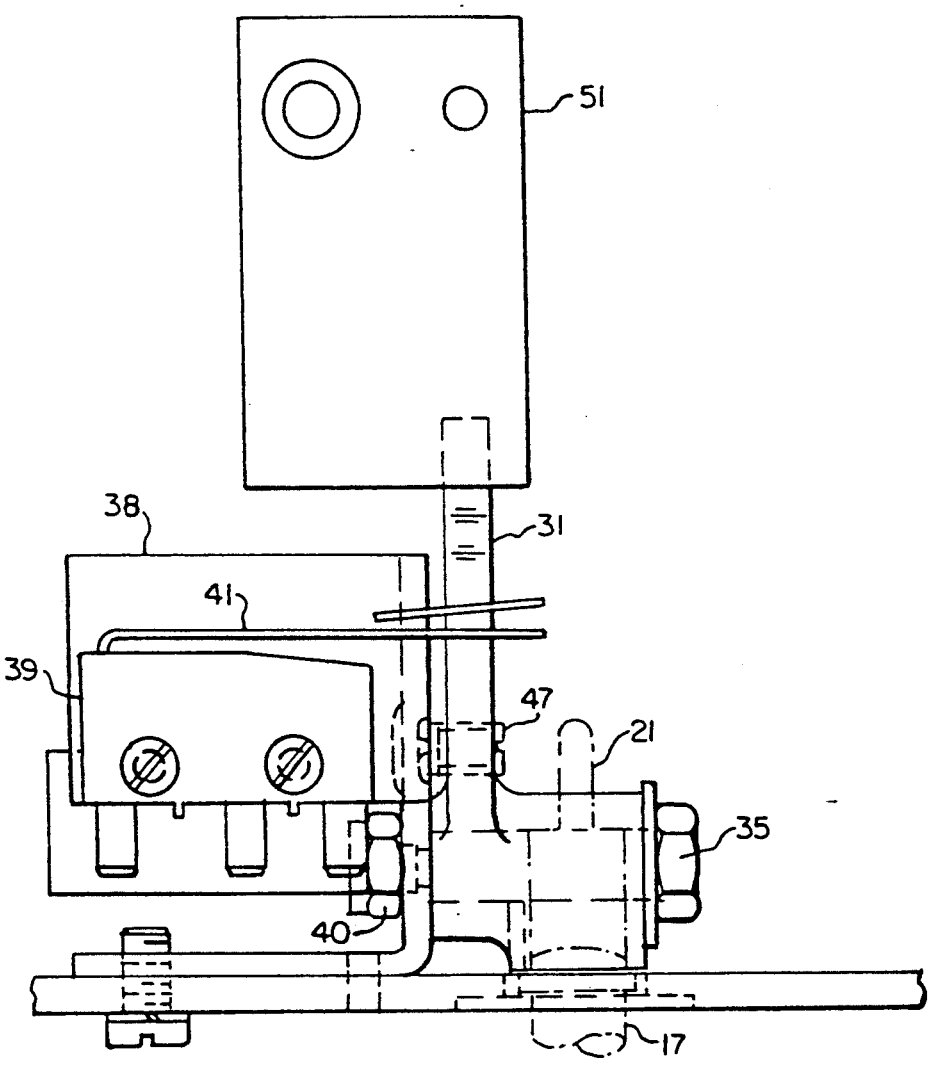
FIG. 3 is a front elevation taken along line 3—3 of FIG. 1 with the external housing and control panel of the circuit breaker removed.

Bracket portion 38 has mounted thereto a conventional electrical switch member 39. (FIG. 1) Switch member 39 has switch activating bar 41. The actuating member 31 of the present invention has arm 43 which protrudes out over switch actuating bar 41. Arm 43 has a surface 45 which is radius so that rotation of actuating member 31 will result in depression of the switch actuating bar 41 thus activating switch 39 as shown in phantom in FIG. 1. The switch 39 is also shown in FIG. 3 which illustrates a front elevational view of the device of the present invention. Switch 39 is preferably connected to an audible alarm or a light indicator. When the circuit breaker trips the alarm or light as desired in the application will be turned on to alert an operator that a trip has occurred. As stated hereinbefore switch 39 is mounted upon bracket portion 38 which is visible in FIG. 2.

In order to assure that the alarm signal remains on until an operator takes affirmative steps to reset the alarm, actuating member 31 is designed so that it rotates with plunger 17 upon a trip event, but it does not move downwardly when the plunger 17 returns to its retracted position. As noted above legs 33 and 34 are lifted by annular shoulder 19 on plunger 17. However, the legs are not in a friction fit relationship with plunger 17 so they do not follow plunger 17 downwardly upon its return to the retracted position. In addition, a detent 46 is provided on bracket portion 37. Detent 46 is a recess in the metal of bracket portion 37. A correspondingly positioned retaining member 47 is provided on actuating member 31. Retaining member 47 is placed on actuating member 31 so that it protrudes towards bracket portion 37. As actuating member 31 rotates into its actuated position upon a trip of the breaker, retaining member 47 engages detent 46 and remains in that position until another force returns actuating member 31 to its initial position as shown in FIG. 1.

The force which returns actuating member 31 to the initial position is preferably provided by a plate 51 (FIG. 1). Plate 51 is connected by suitable connection means 53 to a push button 55 which is located in the external housing 10 of the circuit breaker. When an operator has reset the circuit breaker or otherwise determines that it is appropriate to reset the actuating member 31, the operator simply depresses button 55 which in turn imparts a linear motion to plate 51 causing it to contact a finger 57 on actuating member 31. The force applied to finger 57 causes actuating member 31 to rotate into its initial position. This force is great enough to cause retaining member 47 to be removed from detent 46.

Figure 4:
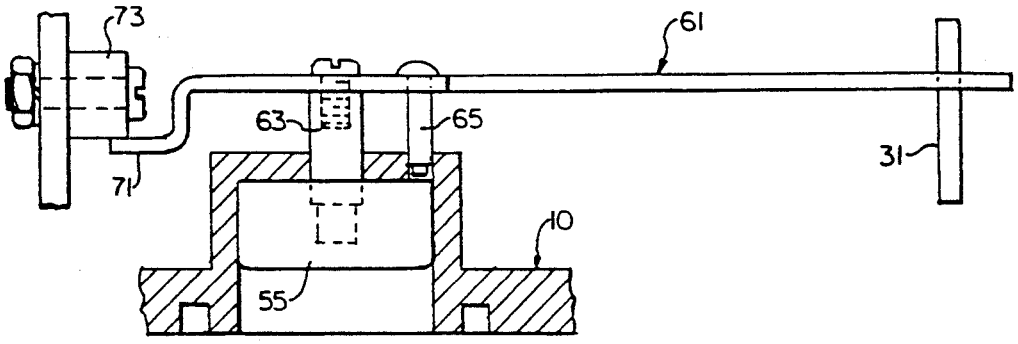
FIG. 4 is a top plan illustration of a bracket used in accordance of another embodiment of the invention.
Figure 5:
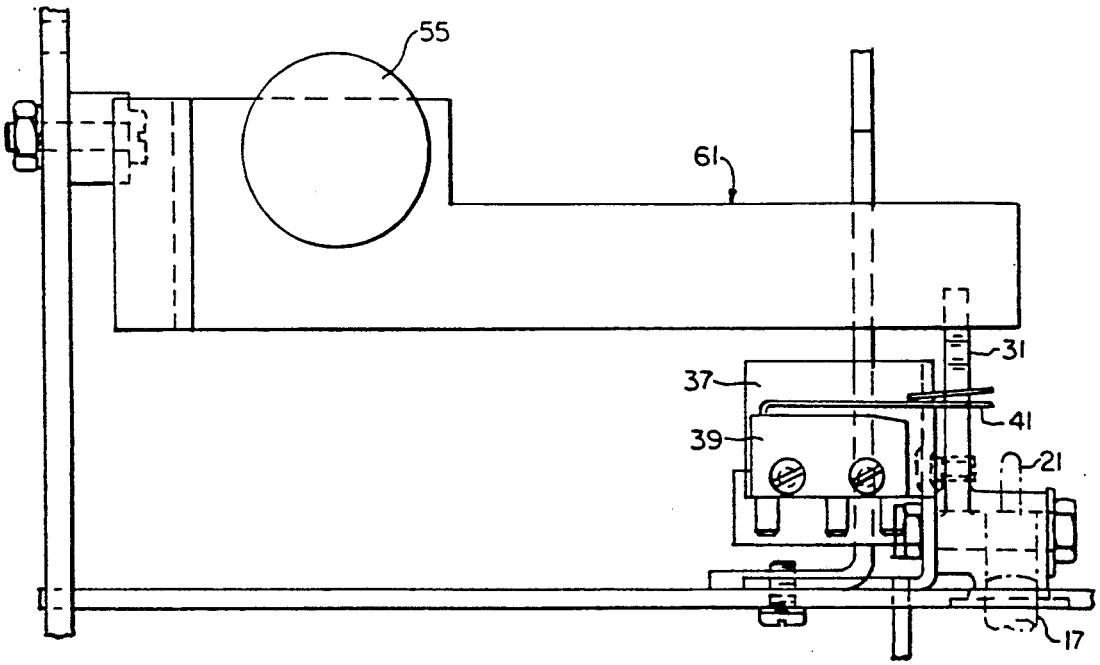
FIG. 5 is an illustration of the device of FIG. 3 showing the long bracket shown in FIG. 4.

In accordance with yet another embodiment of the invention the actuating member 31 may be located with respect to the housing 10 such that a longer plate is necessary to reset actuating member 31. Referring to FIG. 4, it is noted that push button 55 in this FIG. is some distance from actuating member 31. For purposes of clarity, the remainder of the components are not shown in FIG. 4. Reset bracket 61 is bolted onto button 55 by suitable fastening means 63. Guide pin 65 may also be added to provide additional guidance to the bracket upon depression of button 55. When button 55 is depressed, the opposite end 71 of reset bracket 61 abuts spacer 73 which maintains end 71 in a stationary position. Thus, bracket 61 rotates generally counterclockwise as viewed in FIG. 4 and forces actuating member 31 back to its initial position in a similar manner as that described with reference to the embodiment of FIG. 1. Another view of the embodiment of FIG. 4 is shown in FIG. 5. Push button 55 engages reset bracket 61 which in turn engages actuating member 31 when it is desired to reset actuating member 31 to its initial position.

In some applications of the invention, a spring 77 (FIG. 1) may be provided in order to bias actuating member 31 into the initial position. This can be desirable when the circuit breaker is mounted in close proximity to a generator or other equipment which may be vibrating and cause undesired motion of the actuating member 31 prior to a trip event. Preferably, spring 77 is mounted at one end in aperture 79 of actuating member 31 and at an opposite end in cut out portion 81 of bracket portion 37.

In operation, the flux shunt trip device (FIG. 1) is energized with current when the current in the power system with which the circuit breaker is used is at a predetermined trip level. This energization creates a flux which opposes the flux of the permanent magnet (not shown) also contained within flux shunt trip device 15. When the two fluxes oppose one another this allows the spring-activated plunger 17 to move to an extended position. This in turn activates trip mechanism 23, 25. Up to this point actuating member 31 would have been in its initial position. In its initial position, actuating member 31 has legs 33 and 34 which loosely surround plunger 17 and rest upon annular shoulder 19 of plunger 17. Plunger 17 is forced into its extended position on a trip event and annular shoulder 19 pushes legs 33 and 34 upwardly which in turn causes the entire actuating member to rotate about pivot point 35 into the actuated position. Once in the actuated position, surface 45 of actuating member 31 contacts switch actuating bar 41 which activates the switch to set the alarm or light indicator. This provides a ready indication to an operator that the circuit breaker has tripped.

The present invention provides a low cost and easy-to-use mechanical method of activating alarm switches in circuit breakers having a flux shunt trip device. It avoids the necessity for electronic switching devices which can present problems due to the need for control power supply to such devices.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An alarm assembly for use with a circuit breaker contained within a circuit breaker housing comprising:

a trip mechanism for interrupting current through said circuit breaker when a predetermined current condition is reached;

a flux shunt trip device operatively associated with said trip mechanism, said flux shunt trip device having plunger means movable between an extended position and a retracted position, said plunger means moving to said extended position upon said predetermined condition and directly activating said trip mechanism to interrupt current through said circuit breaker;

an actuating member operatively associated with said plunger means and movable between an initial position and an actuated position, said actuating member engageable directly by said plunger means so that motion of said plunger means to said extended position upon said predetermined condition also causes said actuating member to move from said initial position to said actuated position and said actuating member remains in said actuated position even if said plunger means returns to said retracted position; and an electrical switch mechanism activated by said actuating member when said actuating member moves to said actuated position to generate an alarm signal indicating tripping of the circuit breaker by the flux shunt trip device.

2. The assembly of claim 1 also comprising means retaining said actuating member in said actuated position comprising a support member upon which said actuating member is mounted, one of said members having a detent therein and the other of said member having an extension means protruding therefrom, said extension means protruding into said detent when said actuating means moves to said extended position.

3. The assembly of claim 1 further comprising reset member mounted internally in said housing and positioned so that said reset member engages said actuating member when said reset member is activated externally, and moves said actuating member to its initial position from its actuated position.

4. The assembly of claim 3 further comprising push button means mounted externally on said housing, and having said reset member connected to said push button means internally in said housing, so that manual activation of said push button means causes said reset member to engage said actuating member to return said actuating member to said initial position.

5. The assembly of claim 1 wherein said actuating member has biasing means for biasing said actuating member toward said initial position.

6. The assembly of claim 1 wherein said actuating member is rotatable about pin means so that said actuating means rotates from said initial position to said actuated position.

7. The assembly of claim 6 wherein said pin means is mounted on a bracket adjacent said plunger means of said flux shunt trip device.

8. The assembly of claim 1 wherein said actuating member has leg means extending generally from a base thereof, said leg means being engaged directly by an annular rim on said plunger means when said plunger means moves to said extended position causing said actuating member to move to its actuated position.

* * * * *